US005683974A

United States Patent [19]

Lund et al.

[11] Patent Number: 5,683,974

[45] Date of Patent: Nov. 4, 1997

[54] AZEOTROPE-LIKE COMPOSITIONS OF 1,1,1,3,3-PENTAFLUOROPROPANE AND $C_1$-$C_3$ ALCOHOLS FOR CLEANING

[75] Inventors: Earl August Eugene Lund, deceased, late of West Seneca, by Hilde Lund, executrix; Hang Thanh Pham, Amherst; Ian Robert Shankland, Williamsville; Ellen Louise Swan, Lancaster, all of N.Y.

[73] Assignee: AlliedSignal Inc., Morristown, N.J.

[21] Appl. No.: 667,101

[22] Filed: Jun. 20, 1996

[51] Int. Cl.[6] ..... C11D 7/26; C11D 7/30; C11D 7/50; C23G 5/028

[52] U.S. Cl. ..... 510/177; 510/256; 510/365; 510/411; 510/273; 252/364; 134/11; 134/31; 134/40; 134/12

[58] Field of Search ..... 510/177, 256, 510/365, 411, 412, 415, 273; 252/364; 134/40, 30, 26, 22.14, 22.19, 12, 2, 31, 11, 42

[56] References Cited

U.S. PATENT DOCUMENTS

| | | | |
|---|---|---|---|
| 4,961,869 | 10/1990 | Eggers et al. | 252/170 |
| 4,970,013 | 11/1990 | Merchant | 252/69 |
| 5,104,565 | 4/1992 | Magid et al. | 252/171 |
| 5,106,526 | 4/1992 | Magid et al. | 252/171 |
| 5,118,437 | 6/1992 | Magid et al. | 252/171 |
| 5,124,065 | 6/1992 | Magid et al. | 252/171 |
| 5,219,490 | 6/1993 | Basu et al. | 252/171 |
| 5,424,002 | 6/1995 | Omure et al. | 252/171 |
| 5,433,880 | 7/1995 | Minor et al. | 252/67 |
| 5,445,757 | 8/1995 | Pennetreau | 252/171 |
| 5,496,867 | 3/1996 | Sommerfeld et al. | 521/131 |
| 5,514,221 | 5/1996 | Bolmer | 134/40 |
| 5,531,916 | 7/1996 | Merchant | 510/412 |
| 5,538,659 | 7/1996 | Chisolm et al. | 252/67 |
| 5,552,080 | 9/1996 | Bolmer | 510/412 |
| 5,558,810 | 9/1996 | Minor et al. | 252/67 |
| 5,562,857 | 10/1996 | Werner et al. | 252/67 |
| 5,578,652 | 11/1996 | Blanpied et al. | 521/107 |
| 5,607,912 | 3/1997 | Samejima et al. | 510/411 |
| 5,611,210 | 3/1997 | Nimitz et al. | 62/114 |

FOREIGN PATENT DOCUMENTS

| | | | |
|---|---|---|---|
| 618288 | 10/1994 | European Pat. Off. | C11D 7/50 |
| 8259502 | 10/1996 | Japan | C07C 69/63 |

*Primary Examiner*—Douglas J. McGinty
*Attorney, Agent, or Firm*—Jay P. Friedenson

[57] ABSTRACT

Novel azeotrope-like compositions of 1,1,1,3,3-pentafluoropropane and $C_1$–$C_3$ alcohols or mixtures thereof are useful in solvent cleaning.

19 Claims, No Drawings

AZEOTROPE-LIKE COMPOSITIONS OF 1,1,1,3,3-PENTAFLUOROPROPANE AND $C_1$-$C_3$ ALCOHOLS FOR CLEANING

FIELD OF THE INVENTION

This invention relates to azeotrope-like compositions of 1,1,1,3,3-pentafluoropropane and $C_1$–$C_3$ alcohols (methanol, ethanol, n-propanol and isopropanol or mixtures thereof). These compositions are useful as solvents.

BACKGROUND OF THE INVENTION

Fluorocarbon based fluids have found widespread use in industry for solvent cleaning, for example, in the degreasing and otherwise cleaning of solid surfaces, especially intricate parts and difficult to remove soils.

Solvent cleaning is commonly accomplished by vapor degreasing, which in its simplest form consists of exposing a room temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing fleshly distilled solvent near room temperature, and finally exposing the part to solvent vapors over the boiling sump which condense on the cleaned part. In addition, the part can also be sprayed with distilled solvent before final rinsing.

The low boiling point of the solvent compositions of the invention will require a closed system machine. This type of vapor degreaser consists of a chamber in which the substrates are placed and sealed. The chamber is then evacuated and the solvent pumped into the chamber for cleaning. After cleaning the solvent is removed before opening the system and removing the parts or substrates.

The compositions of the invention are also useful in aerosol applications for cleaning, deposition of certain types of lubricants or as a dust off, freeze spray or tire inflator. In an aerosol product the material is propelled from an aerosol can or container using a propellant.

Azeotropic or azeotrope-like compositions are desired because they do not fractionate upon boiling. This behavior is desirable because in the previously described vapor degreasing equipment in which these solvents are commonly employed, redistilled material is generated for final rinse-cleaning. Thus, the vapor degreasing system acts as a still. Unless the solvent composition exhibits a constant boiling point, i.e., is azeotrope-like, fractionation may occur, such as by a leak or accidental escape of vapor in the case of a closed system, and undesirable solvent distribution may act to upset the cleaning and safety of processing. Preferential evaporation of the more volatile components of the solvent mixtures, which would be the case if they were not azeotrope-like, would result in mixtures with changed compositions which may have less desirable properties, such as lower solvency towards soils, less inertness towards metal, plastic or elastomer components, and increased flammability and toxicity.

The art is continually seeking new fluorocarbon based azeotrope-like mixtures which offer alternatives for the above-described applications. Currently, environmentally acceptable fluorocarbon-based materials are of particular interest because the fully halogenated chlorofluorocarbons have been implicated in causing environmental problems associated with the depletion of the earth's protective ozone layer.

The art has looked towards azeotrope or azeotrope-like compositions which include fluorocarbon components such as 1,1,2-trichloro-1,2,2-trifluoroethane (CFC-113) and also include components which contribute additionally desired characteristics, such as polar functionality, increased solvency power, and stabilizers. The substitute material must also possess those properties exhibited by the prior art chlorofluorocarbons including chemical stability, low toxicity, and non-flammability.

It is accordingly an object of this invention to provide novel azeotrope-like compositions based on 1,1,1,3,3-pentafluoropropane and $C_1$–$C_3$ alcohols (methanol, ethanol, n-propanol, isopropanol and mixtures thereof), which are useful in solvent and other applications.

Another object of the invention is to provide novel environmentally acceptable compositions useful as solvents and other applications.

Other objects and advantages of the invention will become apparent from the following description.

SUMMARY OF THE INVENTION

The invention relates to novel azeotrope-like compositions of 1,1,1,3,3-pentafluoropropane and a $C_1$–$C_3$ alcohol (methanol, ethanol, n-propanol, isopropanol and mixtures thereof), which are useful in solvent and other applications as described. The compositions are environmentally acceptable.

DESCRIPTION OF THE INVENTION

In accordance with the invention, novel azeotrope-like compositions have been discovered comprising or consisting essentially of 1,1,1,3,3-pentafluoropropane and $C_1$–$C_3$ alcohols (methanol, ethanol, n-propanol, isopropanol and mixtures thereof).

1,1,1,3,3-pentafluoropropane is a known material, which material and method of preparation is described in WO 95/04022.

The novel azeotrope-like compositions of the invention contain from about 99.9 to about 80 weight percent 1,1,1,3,3-pentafluoropropane and about 0.1 to about 20 weight percent of an alcohol selected from the group of methanol, ethanol, n-propanol, isopropanol and mixtures thereof, which compositions boil at about 14.2° to 14.5° C.±0.5° C./760 mmHg The novel compositions of the invention which incorporate 1,1,1,3,3-pentafluoropropane are azeotrope-like because they are essentially constant boiling versus composition and possess essentially identical liquid and vapor compositions over the aforementioned ranges.

These azeotrope-like mixtures also exhibit zero ozone depletion potential and low atmospheric lifetime; hence, they contribute negligibly to the greenhouse warming effect. This is contrasted with the high ozone depletion potential and correspondingly high greenhouse warming potential of CFC-113.

The azeotropic compositions of this invention uniquely possess all of the desirable features of an ideal solvent i.e., safe to use, non-flammable, zero ozone depletion potential, and negligible greenhouse warming effect.

The term "azeotrope-like" is used herein for mixtures of the invention because in the claimed proportions, the compositions of 1,1,1,3,3-pentafluoropropane and $C_1$–$C_3$ alcohols are constant boiling or essentially constant boiling. All compositions within the indicated ranges, as well as certain compositions outside the indicated ranges, are azeotrope-like, as defined more particularly below.

From fundamental principles, the thermodynamic state of a fluid is defined by four variables: pressure, temperature, liquid composition, and vapor composition, or P—T—X—Y, respectively. An azeotrope is a unique characteristic of a system of two or more components where X and Y are equal at a stated P and T. In practice this means that the components cannot be separated during a phase change, and therefore are useful in solvent and aerosol applications.

For the purposes of this discussion, by azeotrope-like composition is intended to mean that the composition behaves like a true azeotrope in terms of this constant boiling characteristics or tendency not to fractionate upon boiling or evaporation. Thus, in such systems, the composition of the vapor formed during evaporation or upon being propelled from an aerosol can, is identical or substantially identical to the original liquid composition. Hence, during boiling or evaporation, the liquid composition, if it changes at all, changes only slightly. This is contrasted with non-azeotrope-like compositions in which the liquid and vapor compositions change substantially during evaporation or condensation.

One way to determine whether a candidate mixture is azeotrope-like within the meaning of this invention, is to distill a sample thereof under conditions (i.e., resolution—number of plates) which would be expected to separate the mixture into its separate components. If the mixture is non-azeotrope or non-azeotrope-like, the mixture will fractionate, i.e., separate into its various components with the lowest boiling component distilling off first, and so on. If the mixture is azeotrope-like, some finite amount of the first distillation cut will be obtained which contains all of the mixture components and which is constant boiling or behaves as a single substance. This phenomenon cannot occur if the mixture is not azeotrope-like, i.e., it is not part of an azeotrope system.

It follows from the above that another characteristic of azeotrope-like compositions is that there is a range of compositions containing the same components in varying proportions which are azeotrope-like. All such compositions are intended to be covered by the term azeotrope-like as used herein. As an example, it is well known that at different pressures the composition of a given azeotrope will vary at least slightly as does the boiling point of the composition. Thus, an azeotrope of A and B represents a unique type of relationship but with a variable composition depending on the temperature and/or pressure. As is readily understood by persons skilled in the art, the boiling point of an azeotrope will vary with the pressure.

In one solvent process embodiment of the invention, the azeotrope-like compositions of the invention may be used to clean solid surfaces by treating said surfaces with the novel compositions of the invention. Such treating may be accomplished in any manner well known in the art such as by dipping or spraying or use of degreasing apparatus.

In another process embodiment of the invention, the azeotrope-like compositions may be sprayed onto a surface by using a propellant. Suitable propellants include chlorofluorocarbons like dichlorodifluoromethane, hydrochlorofluorocarbons like chlorodifluoromethane, hydrofluorocarbons like 1,1,1,2-tetrafluoroethane, ethers like dimethyl ether and hydrocarbons like butane and isobutane.

It should be understood that the present compositions may include additional components so as to form new azeotrope-like compositions. Any such compositions are considered to be within the scope of the present invention as long as the compositions are essentially constant boiling and contain all the essential components described herein.

In addition, the azeotrope-like compositions of the invention may include components which may not form new azeotrope-like compositions.

The present invention is more fully illustrated by the following non-limiting Examples.

EXAMPLES 1–4

The range over which the following compositions exhibit constant boiling behavior was determined using ebulliometry.

1. HFC-245fa/methanol;
2. HFC-245fa/ethanol;
3. I-IFC-245fa/n-propanol;
4. HFC-245fa/isopropanol;

The ebulliometer used in this experiment consisted of a heated sump with a condenser. Measured quantities of HFC-245fa were charged into the ebulliometer and brought to a boil. Then, measured amounts of the alcohol were titrated into the ebulliometer. The change in boiling point was measured with a platinum resistance thermometer.

From about 0.5 to about 20 weight percent methanol, the boiling point of the composition changed by only about 0.5° C. Therefore, the composition behaves as a constant boiling composition over this range.

The preferred, more preferred and most preferred embodiments for each azeotrope-like composition of the invention are listed in Table I. The proportions/ranges listed in the Table are understood to be prefaced by "about".

| Ex. | Components | Preferred Range (wt. %) | More Preferred Range (wt. %) | Most Preferred Range (wt. %) | Boiling Point (°C. @ 760 mmHg) |
|---|---|---|---|---|---|
| 1 | HFC-245fa | 99.5–80 | 99.5–90 | 99–95 | 14.2 ± 0.5 |
| | Methanol | 0.5–20 | 0.5–10 | 1–5 | |
| 2 | HFC-245fa | 99.8–80 | 99.2–90 | 99.2–92 | 14.4 ± 0.5 |
| | Ethanol | 0.2–20 | 0.8–10 | 0.8–8 | |
| 3 | HFC-245fa | 99.9–80 | 99.5–90 | 99.5–94 | 14.4 ± 0.5 |
| | n-propanol | 0.1–20 | 0.5–10 | 0.5–6 | |
| 4 | HFC-245fa | 99.9–80 | 99.7–90 | 99.5–94 | 14.5 ± 0.5 |
| | isopropanol | 0.1–20 | 0.3–10 | 0.5–6 | |

EXAMPLE 5

A performance study was conducted wherein small epoxy printed circuit boards were cleaned using an azeotrope-like composition comprising 96 weight percent 1,1,1,3,3-pentafluoroethane and 4 weight percent methanol as the solvent propelled from an aerosol can using HFC-134a as the propellant. The boards were soiled with flux and reflowed at 350° C. for 30 seconds so as to partially simulate conditions which occur while wave soldering.

An azeotrope-like composition comprising 96 weight percent 1,1,1,3,3-pentafluoroethane and 4 weight percent methanol was dispensed from an aerosol can and propelled by HFC-134a onto the printed circuit board. Five to ten seconds of spraying provided adequate solvent liquid flushing of the printed circuit board for cleaning to occur. The solvent evaporated and left the board dry and clean.

Cleanliness (i.e. total residual materials left after cleaning) of the circuit boards was determined by measuring the ionic residues using an Omega meter. The results indicate that the composition tested is an effective solvent, removing flux from the boards.

Known additives may be used in the present-azeotrope-like compositions in order to tailor the composition for a particular use. Inhibitors may be added to the present azeotrope-like compositions to inhibit decomposition of the compositions; react with undesirable decomposition products of the compositions; and/or prevent corrosion of metal surfaces. Any or all or any combination of the following classes of inhibitors may be employed in the invention: alkanols having 4 to 7 carbon atoms, nitroalkanes having 1 to 3 carbon atoms, 1,2-epoxyalkanes having 2 to 7 carbon atoms, phosphite esters having 12 to 30 carbon atoms, ethers having 3 or 4 carbon atoms, unsaturated compounds having 4 to 6 carbon atoms, acetals having 4 to 7 carbon atoms, ketones having 3 to 5 carbon atoms, and amines having 6 to 8 carbon atoms. Other suitable inhibitors will readily occur to those skilled in the art. The inhibitors may be used alone or as mixtures in any proportion. Typically, up to about 2 percent of inhibitor based on the total weight of the azeotrope-like composition may be used.

What is claimed is:

1. An azeotrope-like composition consisting essentially from about 99.9 to about 80 weight percent 1,1,1,3,3-pentafluoropropane and about 0.1 to about 20 weight percent of an alcohol selected from the group of methanol, ethanol, n-propanol, isopropanol and mixtures thereof, wherein said composition has a boiling point at 760 mmHg of at least about 14.2° C. to 14.5° C.±0.5° C.

2. An Azeotrope-like composition according to claim 1 wherein said alcohol is methanol and wherein said weight percent of 1,1,1,3,3-pentafluoropropane is about 99.5 to about 80 and said weight percent of methanol is about 0.5 to about 20 weight percent, which compositions boil at about 14.2° C. ±0.5° C./ 760 mmHg.

3. An Azeotrope-like composition according to claim 2 wherein said weight percent of 1,1,1,3,3-pentafluoropropane is about 99.5 to about 90 and wherein said weight percent of methanol is about 0.5 to about 10.

4. An Azeotrope-like composition according to claim 2 wherein said weight percent of 1,1,1,3,3-pentafluoropropane is about 99 to about 95 and wherein said weight percent of methanol is about 1 to about 5.

5. An Azeotrope-like composition according to claim 1 wherein said alcohol is ethanol and wherein said weight percent of 1,1,1,3,3-pentafluoropropane is about 99.8 to about 80 and said weight percent of ethanol is about 0.2 to about 20, which compositions boil at about 14.4° C.±0.5° C./ 760 mmHg.

6. An Azeotrope-like composition according to claim 5 wherein said weight percent of 1,1,1,3,3-pentafluoropropane is about 99.2 to about 90 and wherein said weight percent of ethanol is about 0.8 to about 10.

7. An Azeotrope-like composition according to claim 5 wherein said weight percent of 1,1,1,3,3-pentafluoropropane is about 99.2 to about 92 and wherein said weight percent of ethanol is about 0.8 to about 8.

8. An Azeotrope-like composition according to claim 1 wherein said alcohol is n-propanol and wherein said weight percent of 1,1,1,3,3-pentafluoropropane is about 99.9 to about 80 and said weight percent of n-propanol is about 0.1 to about 20, which compositions boil at about 14.4° C.±0.5° C./ 760 mmHg.

9. An Azeotrope-like composition according to claim 8 wherein said weight percent of 1,1,1,3,3-pentafluoropropane is about 99.5 to about 90 and said weight percent of n-propanol is about 0.5 to about 10.

10. An Azeotrope-like composition according to claim 8 wherein said weight percent of 1,1,1,3,3-pentafluoropropane is about 99.5 to about 94 and said weight percent of n-propanol is about 0.5 to about 6.

11. An Azeotrope-like composition according to claim 1 wherein said alcohol is isopropanol and wherein said weight percent of 1,1,1,3,3-pentafluoropropane is about 99.9 to about 80 and said weight percent of isopropanol is about 0.1 to about 20, which compositions boil at about 14.5° C.±0.5° C./ 760 mmHg.

12. An Azeotrope-like composition according to claim 11 wherein said weight percent of 1,1,1,3,3-pentafluoropropane is about 99.7 to about 90 and said weight percent isopropanol is about 0.3 to about 10.

13. An Azeotrope-like composition according to claim 11 wherein said weight percent of 1,1,1,3,3-pentafluoropropane is about 99.5 to about 94 and said weight percent of isopropanol is about 0.5 to about 6.

14. An Azeotrope-like composition of claim 1 consisting essentially of about 96 weight percent of 1,1,1,3,3-pentafluoropropane and about 4 weight percent of methanol.

15. The method of cleaning a solid surface which comprises treating said surface with an azeotrope-like composition as defined in claim 1.

16. The method of cleaning a solid surface which comprises treating said surface with an azeotrope-like composition as defined in claim 5.

17. The method of cleaning a solid surface which comprises treating said surface with an azeotrope-like composition as defined in claim 8.

18. The method of cleaning a solid surface which comprises treating said surface with an azeotrope-like composition as defined in claim 11.

19. The method of cleaning a solid surface which comprises treating said surface with an azeotrope-like composition as defined in claim 14.

* * * * *